US007384292B2

(12) United States Patent
Cadoret

(10) Patent No.: US 7,384,292 B2
(45) Date of Patent: Jun. 10, 2008

(54) HIGH-VOLTAGE ELECTRICAL CONNECTOR CAPABLE OF BEING IMMERSED IN A FLUID ENVIRONMENT

(75) Inventor: Yves Cadoret, Le Mans (FR)

(73) Assignee: Carrier Kheops Bac, Le Mans (FR)

( * ) Notice: Subject to any disclaimer, the term of this patent is extended or adjusted under 35 U.S.C. 154(b) by 0 days.

(21) Appl. No.: 11/643,803

(22) Filed: Dec. 22, 2006

(65) Prior Publication Data

US 2007/0167075 A1 Jul. 19, 2007

(30) Foreign Application Priority Data

Dec. 26, 2005 (FR) ..... 05 13322

(51) Int. Cl.
*H01R 13/52* (2006.01)

(52) U.S. Cl. ..... 439/274; 439/584; 439/585; 439/587

(58) Field of Classification Search ..... 439/190, 439/271, 598, 274, 75
See application file for complete search history.

(56) References Cited

U.S. PATENT DOCUMENTS

| | | | | |
|---|---|---|---|---|
| 3,534,322 | A | 10/1970 | Hoffa | |
| 3,641,479 | A * | 2/1972 | O'Brien et al. | 439/277 |
| 5,011,432 | A * | 4/1991 | Sucht et al. | 439/584 |
| 5,801,465 | A * | 9/1998 | Yamada | 310/71 |
| 6,022,237 | A * | 2/2000 | Esh | 439/348 |

FOREIGN PATENT DOCUMENTS

| | | |
|---|---|---|
| FR | 2 485 282 A | 12/1981 |
| FR | 2 821 155 A | 8/2002 |

* cited by examiner

*Primary Examiner*—Him Un
*Assistant Examiner*—X. Chung-Trans
(74) *Attorney, Agent, or Firm*—Sughrue Mion, PLLC

(57) ABSTRACT

A high-voltage electrical connector, including, on the one hand, at the connection of a contact part and of a corresponding electrical conducting cable of at least one connector part and, on the other, at a take-up of an electromagnetic shielding element of at least one connector part, at least one air-tight cavity that is electrically isolated and able to collect air imprisoned in the electrical conducting cable.

4 Claims, 2 Drawing Sheets

HIGH-VOLTAGE ELECTRICAL CONNECTOR CAPABLE OF BEING IMMERSED IN A FLUID ENVIRONMENT

FIELD OF THE INVENTION

The invention relates to a high-voltage electrical connector capable of being immersed in a fluid environment and, in particular, an electrical connector capable of being immersed in a marine environment and at great depths.

BACKGROUND

Such a connector may be subject to problems of electrical breakdown with the electrical high voltage that it carries, and to problems of electrical insulation of its shielding, notably due to the traces of air contained in the conducting cables. Indeed, the air contained within the conducting electrical cable connected to the connector can pose serious electrical problems if it is transferred as far as the contact part of one of the parts of the connector and similarly as far as the shielding take-up of this part.

SUMMARY

In order to solve these problems, the connector according to the invention comprises, on the one hand, at the connection of the contact part and of the corresponding electrical conducting cable of at least one of the connector parts and, on the other, at the take-up of the electromagnetic shielding element (grounded) of at least one of the connector parts, at least one air-tight cavity that is electrically isolated and able to collect the air imprisoned in the electrical conducting cable.

This cavity may be formed by at least one conducting ring or sleeve assembled with air-tight seals between the said contact part and end sleeving of the electrical conducting connection cable, and similarly at the shielding take-up between the downstream part and the upstream part of the conducting cable, relative to the shielding take-up. This cavity has its internal wall at the same electrical potential both in the case of the connection of the contact part and of the end of the electrical conducting cable of one of the connector parts, and of the shielding take-up of one of the connector parts.

The result of this disposition is that any trace of air from the electrical conducting cable is imprisoned within a cavity at the same electrical potential, at the end of the conducting cable connected to the contact element of the corresponding connector part, or at the location of the shielding take-up of the corresponding connector part on the electrical conducting cable, this air thus no longer being able to be carried into the connector part with the risk of creating partial discharges inherent to electrical high voltage, and then of causing electrical breakdown of the connector and also of creating, relative to the shielding, interference-causing electric fields.

BRIEF DESCRIPTION OF THE DRAWINGS

The invention is illustrated hereinbelow with the aid of an exemplary embodiment and with reference to the appended drawings, in which.

THE DESCRIPTION OF AN EMBODIMENT

The description will be presented with reference to an immersed electrical connector, simply by way of exemplary embodiment of the invention, the latter being applicable to other types of connector.

Reference will be made to the French patent application No. 03 14086 of 1 Dec. 2003 in the name of the applicant and which relates to an electrical connector connectable in water or in a liquid environment, the connector according to the present invention being of the type described in this patent application.

Figure 1:
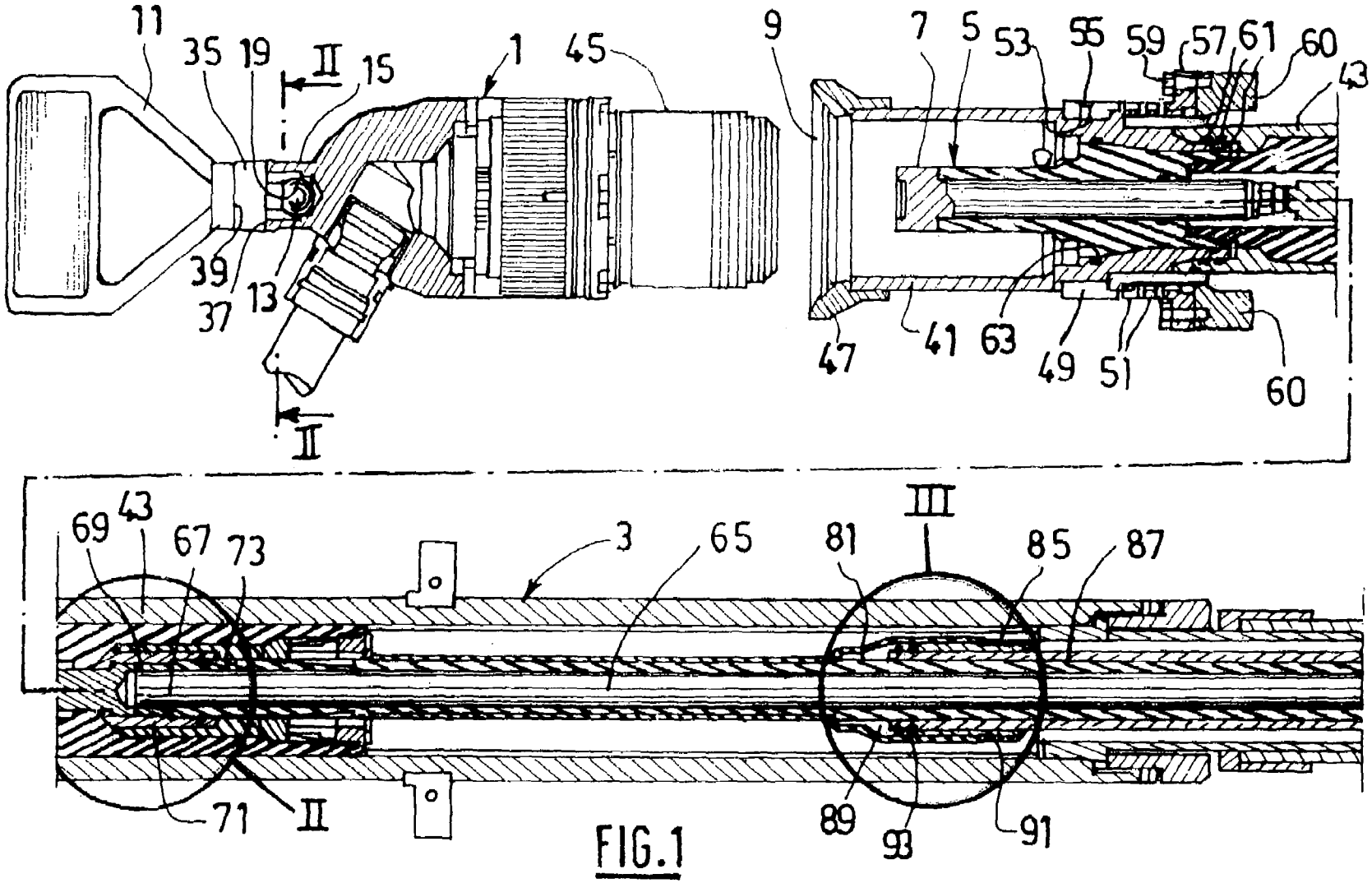
FIG. 1 is a partial axial cross-sectional view of an electrical connector according to the invention, in the disconnected position.

The connector according to the invention, such as is shown in FIG. 1, comprises a mobile connector part or plug 1 and a fixed connector part or receptacle 3. In the present case, the plug 1 is the female connector part and the receptacle 3 is the male connector part. This connector is of cylindrical form with axial symmetry and comprises a single contact 5 positioned in the axis of the connector, but it could comprise other identical contacts disposed in parallel within the cross section of the connector.

The receptacle 3 comprises a contact pin 7 of axial cylindrical form, disposed within the front part of the receptacle and slightly back from its opening 9.

When the connector is coupled together and the plug 1 is engaged into the receptacle 3, the pin 7 of the receptacle penetrates, in a sealed manner, into a complementary opening (not shown) of the front face of the plug, which face is closed in the unused position by a piston pushed forwards (not shown, reference may be made to the aforementioned patent application). It penetrates into a contact chamber (not shown), generally of the metal elastic socket type, where the contact is established when the connector is coupled together.

Figure 2:
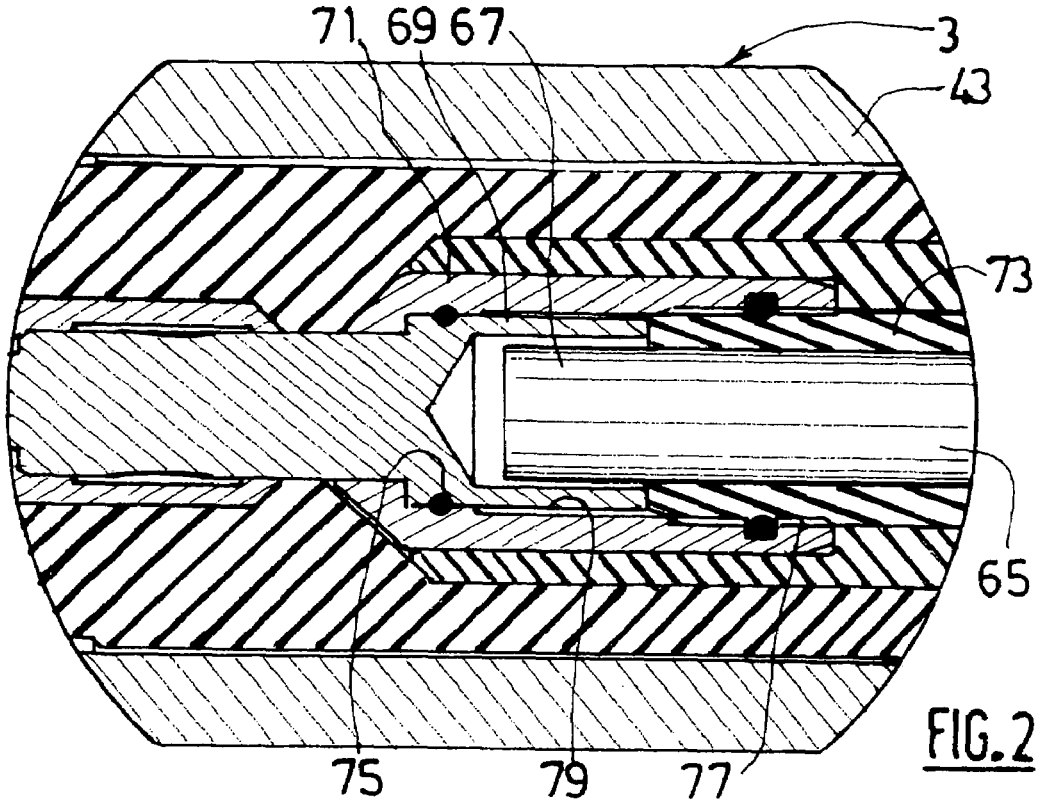
FIG. 2 is an enlarged axial cross-sectional view of the air-tight assembly of the end of the electrical conducting cable connected to the contact element of the receptacle.

The isolation from air of the electrical conducting cable 65 at its connection end at a conductor part indicated by the highlight circle II of FIG. 1 is more particularly illustrated in FIG. 2.

The end 67 of the conducting cable 65 of the receptacle and similarly for the plug is received in a rear socket joint 69 that is complementary to the end of the contact element 5. The junction is made for example by tin soldering. A conducting ring 71, for example made of brass, of cylindrical form and of internal diameter equivalent to that of the sleeving of the connector cable, is installed at the junction 67 of the conducting cable 65 and of the contact element 5; it surrounds the contact socket joint 69 of the contact element 5 on its front part and the insulating sleeving 73 of the electrical cable 65 over a short length on its rear part. It is installed with air-tight seal onto the contact socket joint 69 using a flexible O-ring 75 inserted between these parts and similarly installed with air-tight seal onto the electrical conducting cable sleeving using a flexible O-ring 77 inserted between the sleeving 73 and the ring 71. Thanks to this disposition, the traces of air present in the conducting cable 65, inside the sleeving 73, are channelled up to the end 67 of the cable and remain trapped within the air-tight cavity 79 formed by the space existing between the two sealing O-rings 75, 77, the ring alignment opening, the external wall of the socket joint 69 and the external wall of the sleeving 73. This air cannot get into the connector part and therefore has no effect on the connector.

Figure 3:
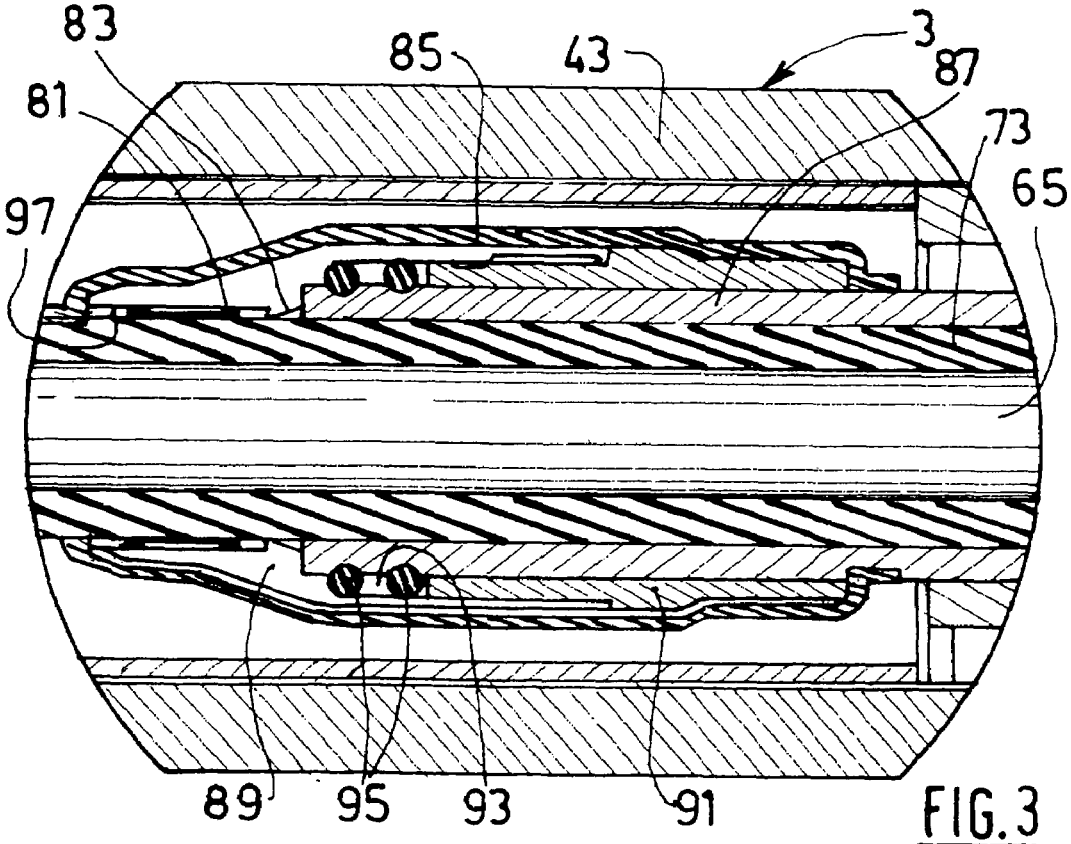
FIG. 3 is an enlarged axial cross-sectional view of the air-tight assembly of the shielding take-up of the conducting electrical cable on the connector receptacle.

The isolation from air at the grounded shielding take-up 81 of the conducting cable 65 inside the receptacle 3 (and similarly for the plug 1) is illustrated in FIG. 3, corresponding to the highlight circle III in FIG. 1.

This shielding take-up 81 of the conducting cable 65 corresponds to a baring of the shielding braid 83, which is connected to a conventional braiding grounding lug (not shown). This shielding take-up 81 is surrounded by a conducting sleeve field expander 85, which surrounds with a air-tight grip the insulating sleeving 73 of the conducting cable 65 upstream of the shielding take-up 81, and similarly surrounds the conducting cable 65 downstream on its second coaxial sleeving 87 (protecting the shielding braid 83). This field expander sleeve 85 encloses two conducting rings assembled together, one front ring 89 surrounding the shielding take-up 81 and one rear ring 91 applied onto the second coaxial sleeving 87 and connecting the braiding 83 to the grounding lug. An internal annular interval 93 is provided in between the two rings 89, 91, which receives at least one flexible annular seal and for example two flexible annular air-tight seals 95, inserted between the front ring 89 and the second insulating sleeving 87. Under these conditions, any trace of air present in the cable 65 at the shielding take-up 81 is trapped in the free space or cavity 97 existing between the front end of the field expander sleeve 85 and the air-tight seals 95, and bounded by the internal opening of the front ring 89 and the external wall of the first insulating sleeving 73. This air thus imprisoned cannot circulate inside the connector so as to create electromagnetic interference.

The invention thus provides an immersed high-voltage electrical connector with high electrical reliability.

The invention claimed is:

1. A high-voltage electrical connector, comprising:

(i) a connection of a contact part and an electrical conducting cable of at least one of first and second connector parts; and (ii) a take-up of an electromagnetic shielding element of said at least one of the first and second connector parts, at least two air-tight cavities that are electrically isolated and able to collect air imprisoned in the electrical conducting cable, wherein one of the at least two air-tight cavities present at the connection (i) of the contact part and the conducting cable is formed by at least one conducting ring or sleeve assembled with air-tight seals between the contact part and an end sleeving of the electrical conducting cable, and wherein the other of the at least two air-tight cavities present at the take-up (ii) is surrounded by (a) a conducting sleeve field expander, (b) a conducting front ring surrounding the take-up of the electromagnetic shielding element, (c) a conducting rear ring applied onto a second coaxial sleeving, and (d) at least one flexible annular air-tight seal positioned between the conducting front ring and the conducting rear ring, at the location of the take-up of the electromagnetic shielding element between a downstream part and an upstream part, relative to the take-up of the electromagnetic shielding element, of the electrical conducting cable.

2. The high-voltage electrical connector according to claim 1, in which each of the at least one air-tight cavity present at the connection (i) and the at least one air-tight cavity present at the take-up (ii) has its internal wall at the same electrical potential.

3. The high-voltage electrical connector according to claim 1, wherein the take-up of the electromagnetic shielding element uncovers a shielding braid of the electrical conducting cable and is surrounded by the conducting sleeve field expander, which surrounds with an air-tight grip the end sleeving of the electrical conducting cable upstream of the take-up of the electromagnetic shielding element, and similarly surrounds the electrical conducting cable on the second coaxial sleeving, which protects the shielding braid, the conducting sleeve field expander enclosing at least two conducting rings assembled with the front ring surrounding the take-up of the electromagnetic shielding element and the rear ring being applied onto the second coaxial sleeving and connecting the shielding braid to a grounding lug, the at least one flexible annular air-tight seal being inserted between the front ring and the second coaxial sleeving.

4. A high-voltage electrical connector, comprising:

(i) a connection of a contact part and an electrical conducting cable of at least one of first and second connector parts, and (ii) a take-up of an electromagnetic shielding element of the at least one of the first and second connector parts, an air-tight cavity at the take-up of the electromagnetic shielding element that is electrically isolated and able to collect air imprisoned in the electrical conducting cable, wherein the air-tight cavity is surrounded by (a) a conducting sleeve field expander, (b) a conducting front ring surrounding the take-up of the electromagnetic shielding element, (c) a conducting rear ring applied onto a second coaxial sleeving, and (d) at least one flexible annular air-tight seal positioned between the conducting front ring and the conducting rear ring, at the location of the take-up of the electromagnetic shielding element between a downstream part and an upstream part, relative to the take-up of the electromagnetic shielding element, of the electrical conducting cable.

* * * * *